US010918961B1

(12) United States Patent
Kalama et al.

(10) Patent No.: US 10,918,961 B1
(45) **Date of Patent: *Feb. 16, 2021**

(54) CONTEXTUALLY CHANGING GUEST MESSAGING AND EXPERIENCE

(71) Applicant: Disney Enterprises, Inc., Burbank, CA (US)

(72) Inventors: Asa K. Kalama, Burbank, CA (US); Casey Ging, Burbank, CA (US); Peter Stepniewicz, Burbank, CA (US); Robert E. Huebner, Burbank, CA (US)

(73) Assignee: DISNEY ENTERPRISES, INC., Burbank, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/671,011

(22) Filed: Oct. 31, 2019

Related U.S. Application Data

(63) Continuation of application No. 16/147,518, filed on Sep. 28, 2018, now Pat. No. 10,500,510.

(60) Provisional application No. 62/610,873, filed on Dec. 27, 2017.

(51) Int. Cl.
*A63G 31/16* (2006.01)

(52) U.S. Cl.
CPC ..... *A63G 31/16* (2013.01)

(58) Field of Classification Search
CPC ..... A63G 31/16; A63G 25/00; A63G 31/15; A63G 31/02; B60W 40/08; G05D 1/0088; B25J 11/0005; G01C 21/365; G06Q 30/0269; G05B 1/01; A63F 9/183; H04N 21/44; H04N 21/8545
USPC ..... 472/59; 381/61, 86; 386/239; 340/13.26
See application file for complete search history.

(56) References Cited

U.S. PATENT DOCUMENTS 6,740,017 B2 * 5/2004 Pino ..... A63B 69/0028 472/62
2003/0106455 A1 * 6/2003 Weston ..... A63G 7/00 104/53
2003/0139219 A1 * 7/2003 Kurzweil ..... A63G 31/00 472/136

(Continued)

OTHER PUBLICATIONS

U.S. Appl. No. 16/147,518, "Non-Final Office Action", dated Jun. 5, 2019, 12 pages.

(Continued)

*Primary Examiner* — Michael D Dennis
(74) *Attorney, Agent, or Firm* — Kilpatrick Townsend & Stockton LLP

(57) ABSTRACT

Systems and methods for a customized amusement ride experience are disclosed herein. Such a system can include a simulation vehicle that can transit at least one passenger from a starting position to a terminating position of the amusement ride, a memory including a content database and a token database, and a sensor that can receive data identifying at least one token. The system can include a processor that can: receive data from the sensor identifying the at least one token; retrieve ride data from the token database based on the data identifying the at least one token, which ride data identifies an attribute associated with the token; select content for delivery based on the ride data; retrieve the selected content for delivery from the content database; and provide the selected content to the at least one passenger of the simulation vehicle.

21 Claims, 5 Drawing Sheets

(56) References Cited

U.S. PATENT DOCUMENTS

| | | | | |
|---|---|---|---|---|
| 2009/0009294 | A1* | 1/2009 | Kupstas | A63G 31/00 340/10.1 |
| 2009/0149246 | A1* | 6/2009 | Opaluch | A63F 13/10 463/29 |
| 2015/0190726 | A1 | 7/2015 | Frolov | |
| 2015/0217187 | A1* | 8/2015 | Hussman | A63F 9/183 463/9 |
| 2015/0224400 | A1* | 8/2015 | Goslin | A63F 13/65 463/24 |
| 2017/0293675 | A1* | 10/2017 | York | G06F 40/226 |

OTHER PUBLICATIONS

U.S. Appl. No. 16/147,518, "Notice of Allowance", dated Jul. 31, 2019, 7 pages.

* cited by examiner

CONTEXTUALLY CHANGING GUEST MESSAGING AND EXPERIENCE

CROSS-REFERENCES TO RELATED APPLICATIONS

This application is a continuation of U.S. application Ser. No. 16/147,518, filed on Sep. 28, 2018, and entitled "CONTEXTUALLY CHANGING GUEST MESSAGING AND EXPERIENCE", which claims the benefit of U.S. Provisional Application No. 62/610,873, filed on Dec. 27, 2017, and entitled "CONTEXTUALLY CHANGING GUEST MESSAGING AND EXPERIENCE", the entirety of which are hereby incorporated by reference herein.

BACKGROUND

The present disclosure relates generally to the sound management in connection with content presentation. Sound forms a significant part of the enjoyment of content consumption. This is especially the case as relating to restricting or eliminating the perceptibility of sounds that do not originate from the content being consumed. In the case of theaters such as movie theaters, this can include attempts at soundproofing of the theater.

BRIEF SUMMARY

One aspect of the present disclosure relates to a system for customized amusement ride experience. The system includes: a simulation vehicle that can transit at least one passenger from a starting position to a terminating position of the amusement ride; a memory including a content database and a token database; a sensor that can receive data identifying at least one token; and a processor. The processor can: receive data from the sensor identifying the at least one token; retrieve ride data from the token database based on the data identifying the at least one token, which ride data identifies an attribute associated with the token; select content for delivery based on the ride data; retrieve the selected content for delivery from the content database; and provide the selected content to the at least one passenger of the simulation vehicle.

In some embodiments, at least one of the at least one passenger is a holder of the token. In some embodiments, the attribute associated with the token includes at least one of: content previously provided by the amusement ride to the holder of the token; and a skill level of the holder of the token. In some embodiments, the selected content includes narration indicative of the attribute associated with the token. In some embodiments, the selected content includes at least a part of: a pre-ride briefing; or a mission. In some embodiments, the pre-ride briefing comprises an introduction to the mission. In some embodiments, the mission includes a plurality of tasks for completion by the at least one passenger of the simulation vehicle. In some embodiments, the plurality of tasks are linked in a narrative.

In some embodiments, selecting content for delivery based on the ride data includes: identifying a relevant subset of the content in the content database; and selecting content from the relevant subset of the content in the content database. In some embodiments, the relevant subset is identified based on the retrieved ride data and includes undelivered content. In some embodiments, the relevant subset includes all of the content in the content database. In some embodiments, selecting content for delivery based on the ride data includes: identifying delivered content; identifying previously provided content in the content database; and selecting content from the identified and previously provided content in the content database.

In some embodiments, the received data from the token includes a unique identifier, In some embodiments, In some embodiments, the unique identifier is not linked with the at least one passenger. In some embodiments, the data received from the sensor identifies a plurality of tokens. In some embodiments, ride data retrieved from the token database is based on the data received identifying a plurality of tokens. In some embodiments, the content is selected for delivery with retrieved ride data based on at least a portion of the retrieved ride data.

One aspect of the present disclosure relates to a method for customized amusement ride experience. The method includes: receiving with a processor data from a sensor, the data identifying at least one token; retrieving with the processor ride data from a token database based on the received data identifying the at least one token, which ride data identifies an attribute associated with the token; selecting with the processor content for delivery to at least one passenger of a simulation vehicle based on the ride data; retrieving with the processor the selected content for delivery from a content database; and providing with the processor the selected content to the at least one passenger of the simulation vehicle.

In some embodiments, at least one of the at least one passenger is a holder of the token. In some embodiments, the attribute associated with the token includes at least one of: content previously provided by the amusement ride to the holder of the token; or a skill level of the holder of the token. In some embodiments, the selected content includes narration indicative of the attribute associated with the token.

In some embodiments, the selected content includes at least a part of: a pre-ride briefing; or a mission. In some embodiments, the pre-ride briefing includes an introduction to the mission. In some embodiments, the mission includes a plurality of tasks for completion by the at least one passenger of the simulation vehicle. In some embodiments, the plurality of tasks are linked in a narrative. In some embodiments, selecting content for delivery based on the ride data includes: identifying a relevant subset of the content in the content database; and selecting content from the relevant subset of the content in the content database.

In some embodiments, the relevant subset is identified based on the retrieved ride data and comprises undelivered content. In some embodiments, the relevant subset includes all of the content in the content database. In some embodiments, selecting content for delivery based on the ride data includes: identifying delivered content; identifying previously provided content in the content database; and selecting content from the identified and previously provided content in the content database. In some embodiments, the received data from the token includes a unique identifier. In some embodiments, the unique identifier is not linked with the at least one passenger. In some embodiments, the data received from the sensor identifies a plurality of tokens, wherein ride data retrieved from the token database is based on the data received identifying a plurality of tokens. In some embodiments, the content is selected for delivery with retrieved ride data based on at least a portion of the retrieved ride data.

DETAILED DESCRIPTION

The ensuing description provides illustrative embodiment (s) only and is not intended to limit the scope, applicability or configuration of the disclosure. Rather, the ensuing description of the illustrative embodiment(s) will provide those skilled in the art with an enabling description for implementing a preferred exemplary embodiment. It is understood that various changes can be made in the function and arrangement of elements without departing from the spirit and scope as set forth in the appended claims.

I. Introduction

Amusement rides entertain passengers via one or several sensory experiences of the passengers of that amusement ride. This can include movement, either real or virtual, of one or several passengers and/or delivery of content. In many instances, content delivery within an amusement ride can be paired with movement, either real or virtual, of the one or several passengers of the amusement ride. This content can include visual, video, and/or audio content that can create an event or effect, or convey a narrative or storyline to the passengers of the amusement ride. This content delivered in connection with an amusement ride can be delivered to one or several passengers of the amusement ride before, during, or after the amusement ride.

As the importance of the content increases with respect to the amusement ride experience, amusement rides risk quickly going stale once a passenger has been on the ride once or twice. However, if a history of the passenger can be determined, or alternatively, if a history of a token possessed by a passenger can be determined, then the content delivered as part of the amusement ride can be customized based on that history. This customization can include modifying pre-ride content delivery and/or delivered content, modifying in-ride content delivery and/or delivered content, and/or modifying post-ride content delivery and/or delivered content. This modification can include modifying one or several scenes, sequences, events, or actions in the content or portrayed in the content, or can include changing all or portions of the content such as, for example, selecting to present one piece of content such as one mission instead of another piece of content such as another mission. Through this customization, the passenger's ride experience can vary with repeat riding of the amusement park.

II. Customized Amusement Ride System

Figure 1:
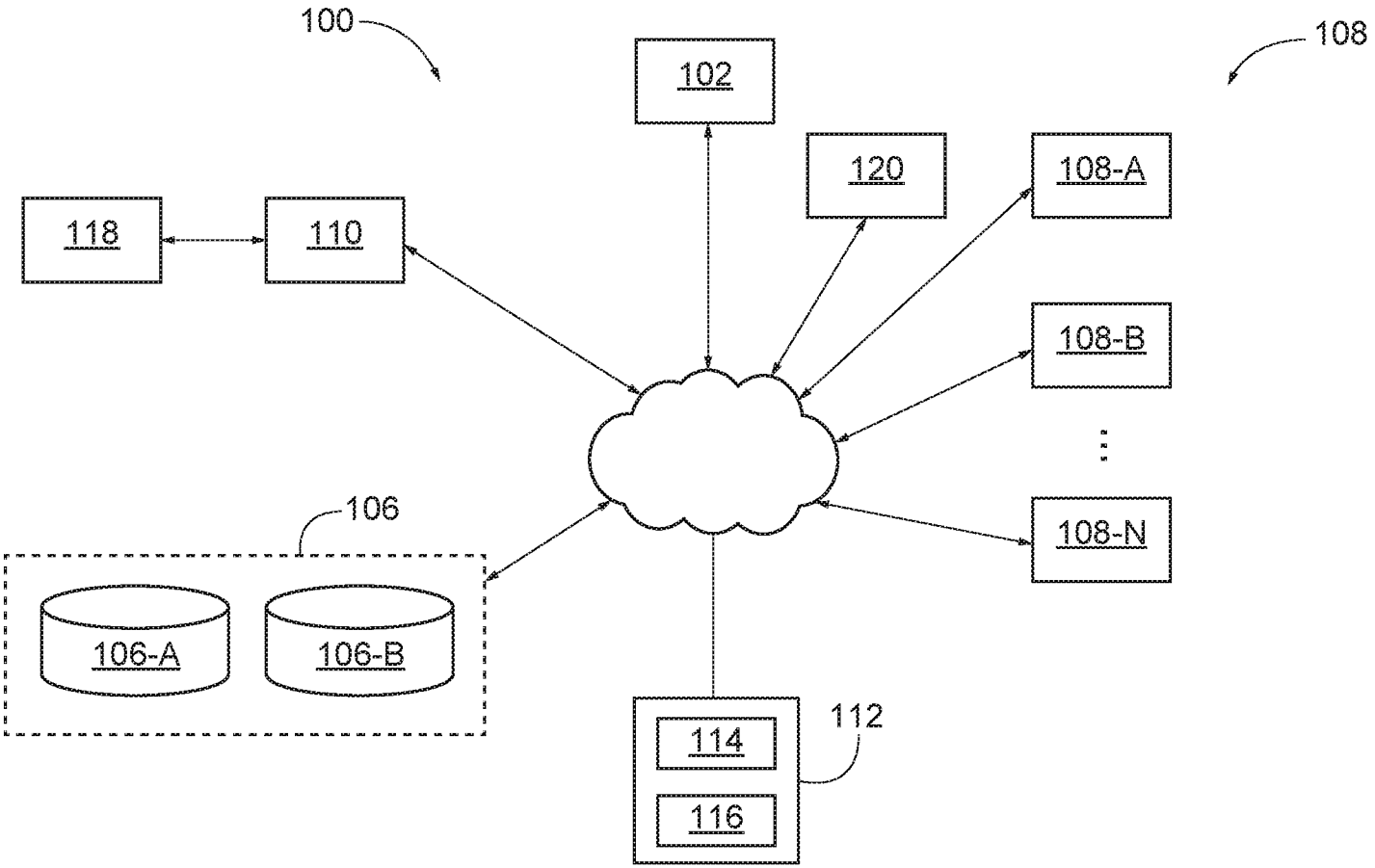
FIG. 1 is a schematic illustration of one embodiment of a system for active sound compensation in proximate theaters.

With reference now to FIG. 1, a schematic illustration of one embodiment of a system 100, also referred to herein as a contextually changing messaging system 100 or customized ride experience system 100 is shown. The system 100 can allow for customization of ride experience and/or of messaging to passengers of an amusement ride. In some embodiments, this customization can be achieved via the identification of a token held by a passenger of the amusement ride, determining an attribute associated with that token such as, for example, a skill level, previously received content, unreceived content, or the like, and selecting and/or providing content based on this attribute associated with the token.

The system 100 can include a processor 102 which can include, for example, one or several processors or servers. The processor 102 can be any computing and/or processing device including, for example, one or several laptops, personal computers, tablets, smartphones, servers, mainframe computers, processors, or the like. The processor 102 can be configured to receive inputs from one or several other components of the system 100, to process the inputs according to one or several stored instructions, and to provide outputs to control the operation of one or several of the other components of the system 100.

The system 100 can include memory 106. The memory 106 can represent one or more storage media and/or memories for storing data, including read only memory (ROM), random access memory (RAM), magnetic RAM, core memory, magnetic disk storage mediums, optical storage mediums, flash memory devices and/or other machine readable mediums for storing information. The term "machine-readable medium" includes, but is not limited to portable or fixed storage devices, optical storage devices, and/or various other storage mediums capable of storing that contain or carry instruction(s) and/or data. The memory 106 can be an integral part of the processor 102 and/or can be separate from the processor 102. In embodiments in which the memory 106 is separate from the processor 102, the memory 106 and the processor 102 can be communicatingly linked via, for example, communications network 130. The communications network 130 can comprise any wired or wireless communication connection between some or all of the components of the system 100.

The memory 106 can include software code and/or instructions for directing the operation of the processor 102 and/or one or several databases 106 containing information used by the processor 102 and/or generated by the processor 102. These databases include, for example, a content database 106-A, and an item or token database 106-B.

The content database 106-A can include content for presentation to passengers of the amusement ride. In some embodiments, this content can comprise video content, audio content, combined video and audio content, or the like. This content can be in the form of one or several films, movies, shows, simulations, interactive stories, or video games. In some embodiments, this content can include a storyline, a plot, or narrative the may be static or that may be dynamic based on received user inputs. This content can include portions that can be presented before a passenger enters a simulation vehicle 108, while the passengers is on the simulation vehicle 108, or after the passenger has excited the simulation vehicle 108.

In some embodiments, content presented before the passenger enters the simulation vehicle 108 can include a pre-ride briefing that can include an introduction to a mission; content presented while the passenger is in the simulation vehicle 108 can include a mission that can include a plurality of tasks for completion by the passenger of the simulation vehicle and that can be linked in a narrative; and content presented after the passenger has exited the simulation vehicle 108 can include a post-ride debriefing that can include a summary or evaluation of performance during the mission. This content can be delivered to the passenger in any desired way including, for example, one or several content presentation systems 112 that can be part of the system 100 or via one or several passenger devices 120 that can receive information from the processor 102.

The pre-ride briefing can include, for example, information and/or content setting-up or preparing for the mission. This can include, for example, a description of the mission and/or of some or all of the tasks in the mission, a characterization on the one or several attributes of the token such as, for example, the skill level previously demonstrated by the holder of the token or message to the holder of the token based on content previously presented to the holder of the token.

The post-ride debriefing can include, for example, information and/or content relating to the completion of the mission and/or one or several uncompleted tasks or missions. In some embodiments, the post-ride debriefing can identify a skill level demonstrated or attained by the holder of the token. In some embodiments, the post-ride debriefing can further include the bestowing of honors, tributes, or awards of the holder of the token based on the completion of the mission and/or on the skill level demonstrated or attained by the holder of the token.

In some embodiments, the content within the content database 106-A can be adaptable based on one or several attribute of a detected token. This adaptability can include, for example, the addition or removal of content include, for example: the addition of one or several scenes, tasks, or scene portions; and/or the modification of content including, for example, the changing of one or several lines, tasks, or events in the content. In some embodiments, content comprising these adaptions can be included in the content database 106-A.

The item database 106-B, also referred to herein as the token database 106-B, can include information identifying one or several tokens and attributes of those one or several tokens. As used herein, a token 118 or an item 118 is an object that includes hardware and/or software to enable communication with one or several components of the system 100. Such hardware can include, for example, an antenna, a receiver, a transmitter, a transceiver, a light source such as: a light emitting diode (LED); a visible LED; an IR LED; a UV LED; and/or a laser diode, and/or a photo sensor such as a photodiode.

This communication between the token 118 and other components of the system 100 can be either passive or active communication, and can include wired or wireless communication via one or several beams of light such as with IR communication, with radio waves such as via Radio Frequency Identification ("RFID"), and/or according to one or several communication protocols such as, for example, Bluetooth or Near Field Communication ("NFC"). In some embodiments, each token can be uniquely identifiably and can be associated with token data. This token data can be, for example, independent of any user data and/or that is not linked with the holder of the token. In some embodiments, this token data can identify, for example, the number of times a holder of the token has been on the amusement ride, content received by the holder of the token while on the amusement ride, and/or a skill level demonstrated by the holder of the token. As used herein, "holder of the token" can be one or several individuals who rode the amusement ride with the token.

The system 100 can include one or several simulation vehicles 108 including, for example, a first simulation vehicle 108-A, a second simulation vehicle 108-B, and up to and including an $N^{th}$ simulation vehicle 108-N. The simulation vehicle 108 can contain one or several passengers in, for example, a seat, a restraint system, or the like. The simulation vehicle 108 can transport passengers from a starting position to a termination position, which starting position can be the location at which passengers enter the simulation vehicle 108 and which termination position can be the location at which the passengers exit the simulation vehicle 108. In some embodiments, the starting position and the termination position can be co-located.

The simulation vehicle 108 and/or the components thereof can be communicatingly connected with the processor 108. This communication connection can allow the providing of information to the simulation vehicle 108, which information can control operation of all or portions of the simulation vehicle 108, and which communicating connection can allow the receipt of information from the simulation vehicle 108 by the server 102, which information can include one or several user inputs at the simulation vehicle 108.

The system 100 can include a sensor 110 that can communicate with one or several tokens 118. The sensor can communicate with tokens of token holders who achieve a desired proximity with the sensor 110. In some embodiments, the sensor 110 can be positioned such that the sensor 110 communicate with tokens of token holders who are entering into the amusement ride and/or are boarding a simulation vehicle 108. To facilitate communication with tokens of token holders boarding the simulation vehicle 108, in some embodiments, the sensor 110 can be positioned proximate to the simulation vehicle 108 such as, for example, at the starting position, and in some embodiments, the sensor 110 can be a part of the simulation vehicle 108.

The sensor 110 can include hardware or software to allow the communication with the one or several tokens. Such hardware can include, for example, an antenna, a receiver, a transmitter, a transceiver, a light source such as: a light emitting diode (LED); a visible LED; an IR LED; a UV LED; and/or a laser diode, and/or a photo sensor such as a photodiode. The sensor 110 can communicate with the one or several tokens 118 via wired or wireless communication via one or several beams of light such as with IR communication, with radio waves such as via RFID, and/or according to one or several communication protocols such as, for example, Bluetooth or NFC. The sensor 110 can be communicatingly connected with the processor 102.

The system 100 can include the content presentation system 112 which can include an audio presentation system 114 and/or a video presentation system 116. The content presentation system 112 can provide or present content to passengers of the amusement ride including to prospective passengers of the amusement ride in the case of a pre-ride briefing, or to past passengers of the amusement ride in the case of a post-ride debriefing.

The content presentation system 112 can include hardware components configured to deliver content to the passengers of the simulation vehicles 108. The components of the content presentation system 112 can include, for example, one or several: speakers; sound generators; displays; screens; monitors; projectors; illuminators; speakers; lasers; fans; or heaters. In some embodiments, each simulation vehicle 108 can include a unique content presentation system 112 and in some embodiments, the content presentation system 112 can be non-unique to some or all of the simulation vehicles 108. In some embodiments in which the simulation vehicle 108 includes unique content presentation system 112, the content presentation system 112 can be a part of the simulation vehicle 108, can be attached to the simulation vehicle 108, and/or can move with the simulation vehicle 108 from the starting point to the termination point.

The content presentation system 112 can provide and/or present audio content via an audio presentation system 112. The audio presentation system 112 can include, for example, an amplifier such as one or several of: a pre-amplifier; a power amplifier; a phono pre-amplifier; a subwoofer amplifier; and an integrated amplifier, one or several speakers such as one or several of: a subwoofer; a tweeter; and a mid-range speaker, a mixing engine, an equalizer, a speaker processor, and/or a scheduler. The content presentation system 112 can provide and/or present video content via a video presentation system 114. The video presentation system can include one or several: screens; displays; monitors; projectors; lasers; and/or light sources.

III. Methods for Customized Amusement Ride Experience

Figure 2:
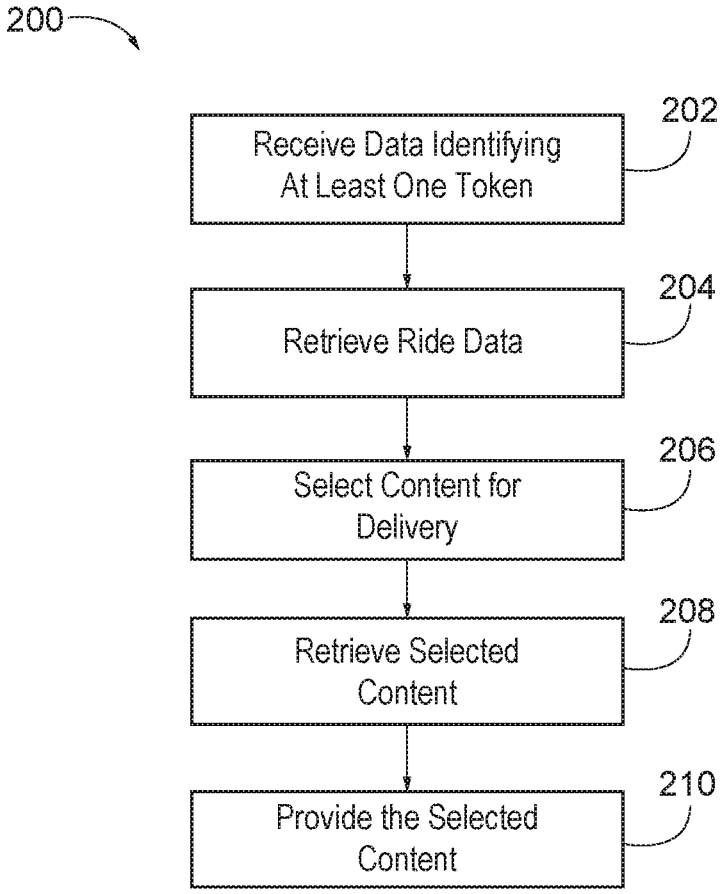
FIG. 2 is a flowchart illustrating one embodiment of a process for generating and/or delivery of a customized amusement ride experience.

With reference now to FIG. 2, a flowchart illustrating one embodiment of a process 200 for generating and/or delivery of a customized amusement ride experience is shown. The process 200 can be performed by all or portions of the system 100, and in some embodiments, can be performed by the processor 102. The process 200 begins at block 202, wherein data identifying at least one token is received. This data can be a unique identifier such that the at least one token is uniquely identified. In some embodiments, this unique identifier is unlinked to the holder of the token. Thus the token and the unique identifier do not identify the holder of the token and/or the passenger of the amusement ride, but rather only identify the token. In some embodiments, this data can be received by the processor 102 as the result of communication between the token 118 and the sensor 110.

At block 204 of the process 200, ride data is retrieved. This ride data can be retrieved from, for example, the token database 106-B with a query for ride data associated with the data received in block 202. The ride data can identify one or several attributes associated with the at least one token for which data was received in block 202. These one or several attributes can identify, for example, content previously provided by the amusement ride to the holder of the token, a skill level of the holder of the token, and/or a preference of the holder of the token. This ride data can be updated, for example, each time the token is identified as riding the amusement ride, to reflect content presented to the holder of the token, the skill level of the holder of the token, and/or one or several preferences of the holder of the token.

In embodiments in which data for a single token is received in block 202, then the ride data retrieved in block 204 is the ride data for that single token. In embodiments in which data for a plurality of tokens is received in block 202, then the ride data retrieved in block 204 can be the ride data for some or all of the tokens in that plurality of tokens. Thus, in embodiments in which data for a plurality of tokens is received in block 202, the token database 106-B can be queried for ride data relevant to some or all of those tokens, and that requested ride data can be received by the processor 102 from the token database 106-B.

At block 206 of the process 200, content is selected for delivery. This content can be selected by the processor 102 from the content database 106-A, and in some embodiments, this content can be selected based on ride data received and/or retrieved in block 204. The content selected in block 206 can be content for presenting as part of the amusement ride. This content can be presented before the passenger enters the simulation vehicle 108 and can include at least a part of a pre-ride briefing, this content can be presented while the passenger is in the simulation vehicle 108 and can include at least a part of a mission that can include a plurality of tasks for completion by the passenger of the simulation vehicle and that can be linked in a narrative, and/or this content can be presented after the passenger has exited the simulation vehicle 108 and can include at least a part of a post-ride debriefing.

In some embodiments, the selection of content for delivery can include the identification of a modification to content. For example, in some embodiments in which the holder of the token has previously ridden the amusement ride, the content can be modified to acknowledge this previous experience. Alternatively, when the holder of the token has previously demonstrated a skill level, the content can be modified to acknowledge that skill level. This acknowledgement can include, for example, changing the mission to better match the skill level, or providing comments or nation acknowledging past success or failure. In such embodiments in which content is modified, the selection of content can include the identification of one or several portions of the content for modification and selecting the desired modification. In some embodiments, this can include identifying a modification matching the attribute of the ride data from the content database 106-A and selecting this identified modification. In some embodiments, the selected content can comprise a scene, a dialogue, an event, a monologue, one or several sounds, or the like. In one embodiment, the selected content can be indicative of the one or several attributes of the token identified in the ride data.

At block 208 of the process 200, the selected content is retrieved. In some embodiments, the selected content can be retrieved from the content database 106-A by the processor 102. At block 210 of the process 200, the selected content is provided. In some embodiments, the selected content can be provided by the processor 102 to the content presentation systems 112 and/or to the one or several passenger devices 120. In some embodiments, the providing of the content can include the generating and sending of one or several control signals by the processor 102 to the content presentation systems 112 and/or to the one or several passenger devices 120, which one or several control signals can direct the operation of the content presentation systems 112 and/or to the one or several passenger devices 120 to present and/or provide the selected content.

Figure 3:
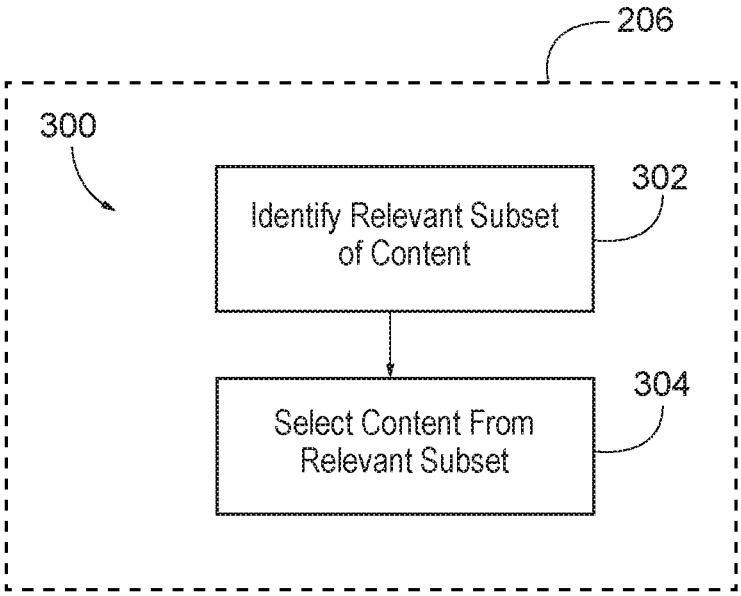
FIG. 3 is a flowchart illustrating one embodiment of a process for selecting content for delivery.

With reference now to FIG. 3, a flowchart illustrating one embodiment of a process 300 for selecting content for delivery is shown. The process 300 can be performed as a part of, or in the place of the step of block 206 of FIG. 2. The process 300 can be performed by all or portions of the system 100 including, for example, the processor 102.

The process 300 begins at block 302, wherein relevant subset of content is identified. This relevant content can be content that matches one or several attributes of the ride data of the token such as, for example, content that has not been previously delivered to the holder of the token, or content that matches a skill level of the holder of the token. The subset of relevant content can be identified by the processor 102.

The relevant subset of content can be identified based on the received ride data. In some embodiments, for example, the ride data can identify content previously delivered to the holder of the token. This content can be compared to the entirety of content stored in the content database 106-A to identify the subset of relevant content. Alternatively, the ride data can include data identifying the undelivered content, and the identification of the subset of relevant content can include the retrieval and/or extraction of this data from the ride data. In some embodiments, the subset of undelivered content can include a portion of the content in the content database 106-A and in some embodiments, the subset of undelivered content can include all of the content in the content database 106-A and/or all of the content in the content database 106-A that is selectable for presentation based on the ride data.

In some embodiments, the relevant content can be identified based on an attribute of the token holder such as the skill level of the holder of the token. In such an embodiment, data indicative of this attribute can be extracted from the retrieved ride data. The identification of the relevant subset of content can then include the querying of the content database 106-A or the searching of the content database 106-A for content and/or content modifications corresponding to this attribute. Content identified in this search of the content database 106-A, or content identified in response to the query of the content database 106-A can be the relevant subset of content.

At block 304 of the process 300, content is selected, and specifically wherein content from the subset of relevant content is selected. In some embodiments, this content can be selected from the subset of relevant content according to selection rules that can be based on, for example, the degree of correspondence between one or several attributes identified in the ride data and content in the subset of relevant content, the number of pieces of content in the subset of relevant content, and/or a random selection procedure. In some embodiments in which the selected content is a previously unprovided mission, the content can be randomly selected from the subset of relevant content that can comprise the previously unprovided missions, the content can be selected from the subset of relevant content according to a predetermined selection sequence, or the content can be selected so as to provide a best match between a difficulty level of the selected content and a skill level of the holder of the token. The content can be selected by the processor 102.

Figure 4:
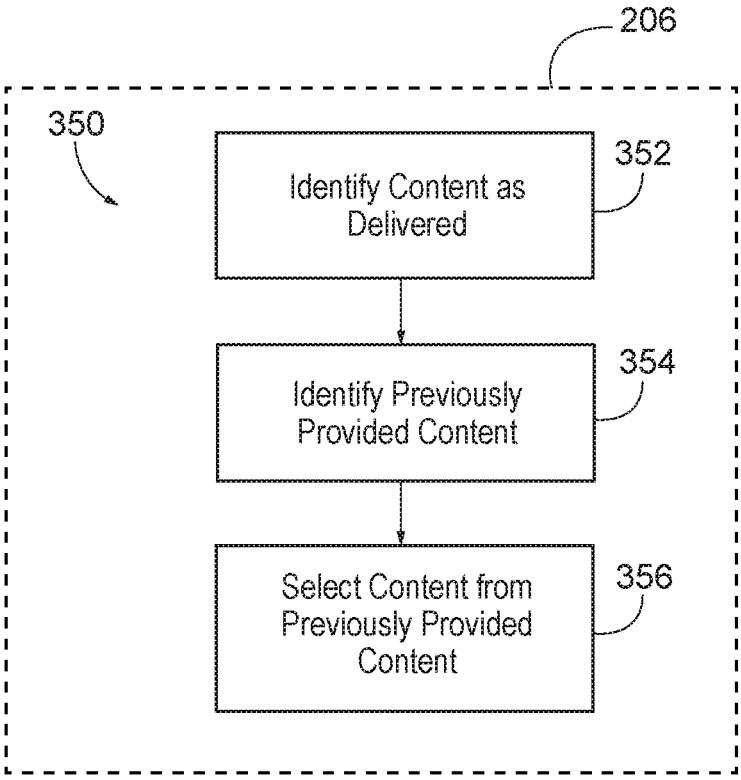
FIG. 4 is a flowchart illustrating one embodiment of a process for selecting content for delivery.

With reference now to FIG. 4, a flowchart illustrating one embodiment of another process 350 for selecting content for delivery is shown. The process 350 can be performed as a part of, or in the place of the step of block 206 of FIG. 2. In some embodiments, the process 350 can be performed when the selected content comprises a mission but when all of the missions have been previously provided to the holder of the token. The process 350 can be performed by all or portions of the system 100 including, for example, the processor 102.

The process 350 begins at block 352, wherein the content is identified as delivered. In some embodiments, this can include identifying and/or determining that all of the content, such as all of the mission, available in the content database 106-A for delivery via the amusement ride has been delivered to the holder of the token, or alternatively identifying that there is no available undelivered content and/or undelivered missions. The identification of the content as delivered can be performed by the processor 102 based on the ride data retrieved in block 204.

At block 354 of the process 350, wherein previously provided content is identified, or alternatively, wherein all available content for delivery via the amusement ride to the holder of the token is identified. This previously provided content or available content can be identified based on information in the ride data retrieved in block 204, which information can identify previously provided content such as, for example, previously provided missions. In some embodiments, the processor 102 can extract this information from the ride data retrieved in block 204 and can use this information to identify previously delivered content.

At block 356 of the process 350, content from the previously provided content or the available content is selected. In some embodiments, as all of the available content has been provided, block 356 can include the selection of previously provided content for repeated presentation to the holder of the token. In some embodiments, this content can be selected based on, for example, the amount of time passed since last providing, the number of times previously provide, an attribute of the holder of the token such as a skill level, or the like. In some embodiments, for example, the content is selected that has been previously presented the smallest number of times to the holder of the token, or for which the most time has passed since the last presentation to the holder of the token. The content can be selected by the server 102.

Figure 5:
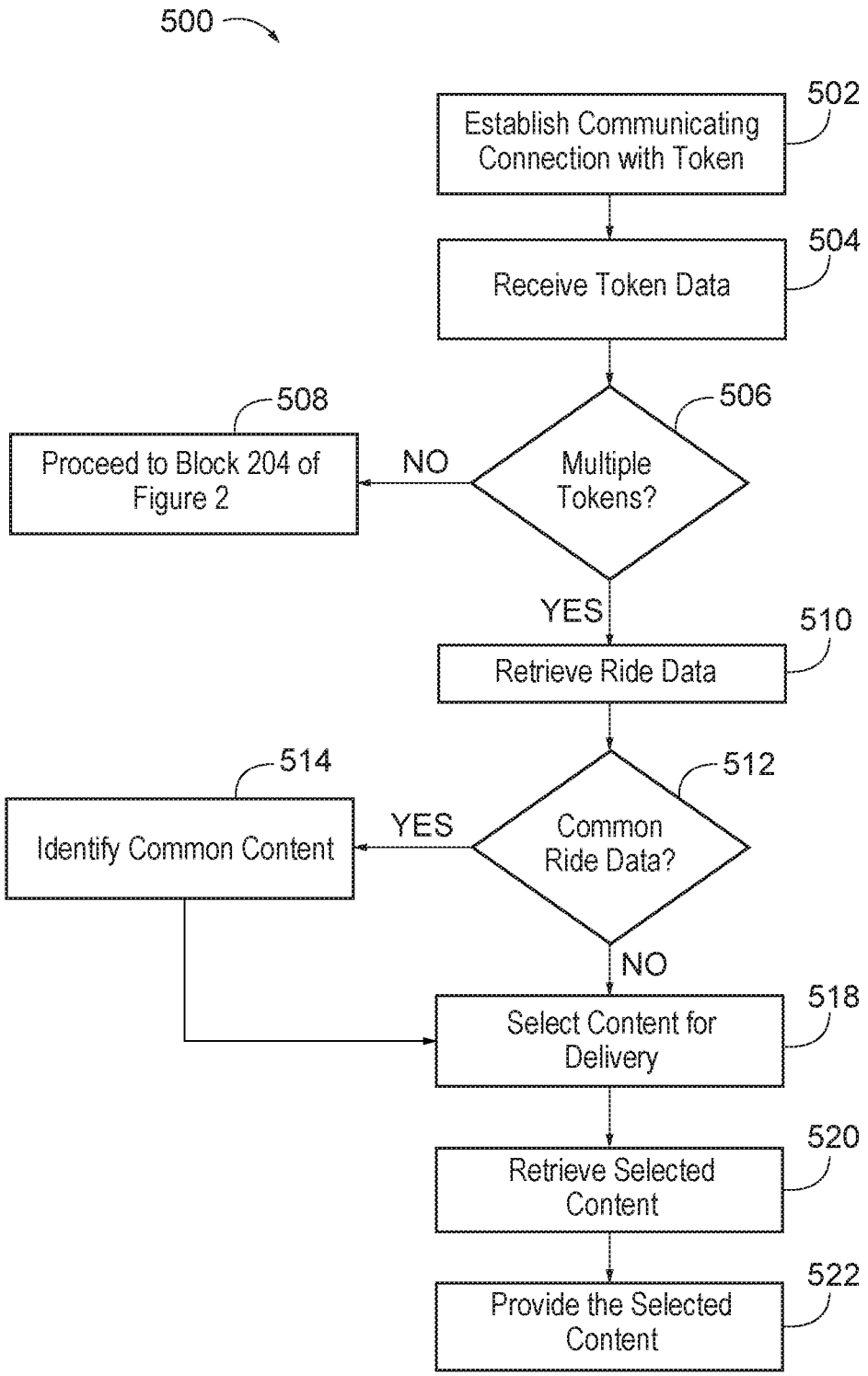
FIG. 5 is a flowchart illustrating an embodiment of a process for generating and/or delivery of a customized amusement ride experience based on token data for one or several tokens.

With reference now to FIG. 5, a flowchart illustrating an embodiment of a process 500 for generating and/or delivery of a customized amusement ride experience based on token data for one or several tokens is shown. The process 500 can be performed by all or portions of the system 100, and in some embodiments, can be performed by the processor 102.

The process 500 begins at block 502, wherein a communicating connection is established between the sensor 110 and the token 118. In some embodiments, this communicating connection can be established with a single token 118 or can be established with a plurality of tokens. This communicating connection can include the establishment of passive communication or active communications between the token 118 and the sensor 110. In some embodiments, this communication can be established when the token 118 comes within a maximum range of the sensor 110. In such an embodiment, the communicating connection can be established when the token 118 receives a communication and/or an energizing signal from the sensor 110 and responds to that communication and/or energizing signal. This response can be received by sensor 110 and can include token data, such as one or several unique identifiers, which can identify one or several tokens.

At decision step 506 of the process 500, it is determined if there multiple tokens are identified in the received token data. In some embodiments, this can include determining whether multiple tokens are identified as boarding a single simulation vehicle 108. If it is determined that there are multiple tokens, then the process 500 proceeds to block 508 and continues to block 204 of FIG. 2, and then proceeds as outlined above with respect to process 200.

If it is determined that there are multiple tokens, then the process 500 proceeds to block 510 and ride data is retrieved. In some embodiments, ride data can be retrieved for some or all of the multiple tokens for which token data was received in block 504. This ride data can be retrieved from the token database 106-B by, for example, the processor 102.

At decision step 512 of the process 500, it is determined if there is common ride data for the multiple tokens. In some embodiments, this can include, for example, determining that the multiple tokens share common ride data. One example of such common ride data can include when the ride data indicates the same previously received content for the multiple tokens, or the same unreceived content for the multiple tokens. In some embodiments, tokens can have common ride data when the ride data of those tokens is identical or when the right data includes commonalities in received or unreceived content. The determination of common ride data can be performed by the server 102.

If it is determined that there is common ride data, then the process 500 proceeds to block 514 wherein common content is identified. This identification of common content can include identifying, for example, content that is identified as unreceived in the ride data of some or all of the multiple tokens, and/or modifications common to some or all of the ride data of some or all of the multiple tokens. Common content can be identified by the server 102 via use of the ride data retrieved in block 510.

After common content has been determined, or returning again to decision step 512, if it is determined that there is no common ride data, then the process 500 proceeds to block 518 wherein content is selected. In embodiments in which there is no common ride data, the selection of content for delivery can correspond to the step of block 206 shown in FIG. 2. Alternatively, if it is determined that there is common ride data, then the selection of content for delivery in block 518 can correspond to the step of block 206 shown in FIG. 2 with the exception that the content is selected from the comment content identified in block 514 of FIG. 5. The content can be selected by the server 102.

At block 520 of the process 500, the selected content is retrieved. In some embodiments, the selected content can be retrieved from the content database 106-A by the processor 102. After the selected content has been retrieved, the process 500 proceeds to block 522, wherein the selected content is provided. In some embodiments, the selected content can be provided by the processor 102 to the content presentation systems 112 and/or to the one or several passenger devices 120. In some embodiments, the providing of the content can include the generating and sending of one or several control signals by the processor 102 to the content presentation systems 112 and/or to the one or several passenger devices 120, which one or several control signals can direct the operation of the content presentation systems 112 and/or to the one or several passenger devices 120 to present and/or provide the selected content.

IV. Computer System

Figure 6:
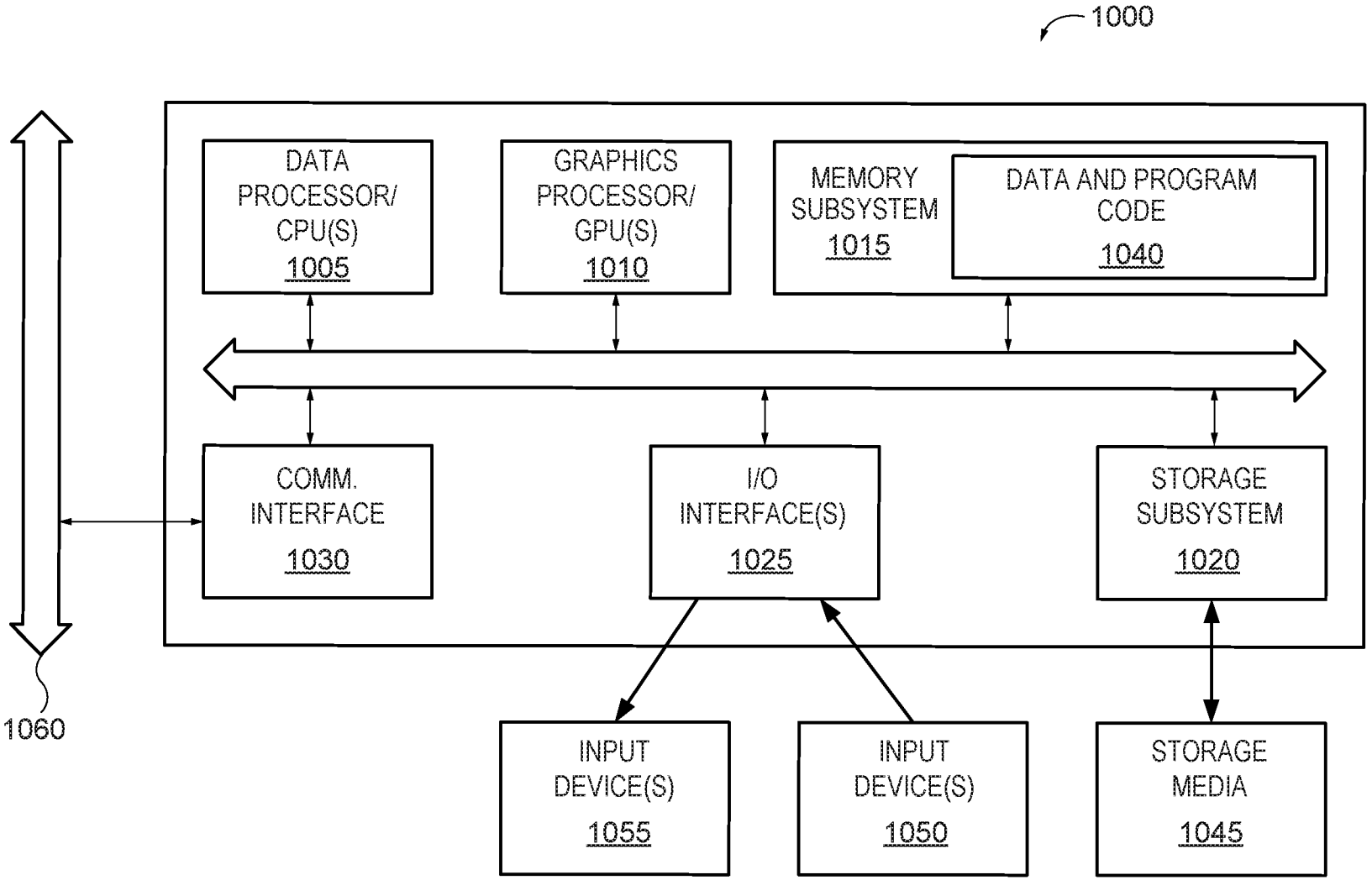
FIG. 6 is a block diagram of a computer system or information processing device that may incorporate an embodiment, be incorporated into an embodiment, or be used to practice any of the innovations, embodiments, and/or examples found within this disclosure.

FIG. 6 shows a block diagram of computer system 1000 that is an exemplary embodiment of the processor 102 and can be used to implement methods and processes disclosed herein. FIG. 6 is merely illustrative. Computer system 1000 may include familiar computer components, such as one or more one or more data processors or central processing units (CPUs) 1005, one or more graphics processors or graphical processing units (GPUs) 1010, memory subsystem 1015, storage subsystem 1020, one or more input/output (I/O) interfaces 1025, communications interface 1030, or the like. Computer system 1000 can include system bus 1035 interconnecting the above components and providing functionality, such connectivity and inter-device communication.

The one or more data processors or central processing units (CPUs) 1005 execute program code to implement the processes described herein. The one or more graphics processor or graphical processing units (GPUs) 1010 execute logic or program code associated with graphics or for providing graphics-specific functionality. Memory subsystem 1015 can store information, e.g., using machine-readable articles, information storage devices, or computer-readable storage media. Storage subsystem 1020 can also store information using machine-readable articles, information storage devices, or computer-readable storage media. Storage subsystem 1020 may store information using storage media 1045 that can be any desired storage media.

The one or more input/output (I/O) interfaces 1025 can perform I/O operations and the one or more output devices 1055 can output information to one or more destinations for computer system 1000. One or more input devices 1050 and/or one or more output devices 1055 may be communicatively coupled to the one or more I/O interfaces 1025. The one or more input devices 1050 can receive information from one or more sources for computer system 1000. The one or more output devices 1055 may allow a user of computer system 1000 to view objects, icons, text, user interface widgets, or other user interface elements.

Communications interface 1030 can perform communications operations, including sending and receiving data. Communications interface 1030 may be coupled to communications network/external bus 1060, such as a computer network, a USB hub, or the like. A computer system can include a plurality of the same components or subsystems, e.g., connected together by communications interface 1030 or by an internal interface.

Computer system 1000 may also include one or more applications (e.g., software components or functions) to be executed by a processor to execute, perform, or otherwise implement techniques disclosed herein. These applications may be embodied as data and program code 1040. Such applications may also be encoded and transmitted using carrier signals adapted for transmission via wired, optical, and/or wireless networks conforming to a variety of protocols, including the Internet.

The above description of exemplary embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated.

What is claimed is:

1. A system for customized content delivery for an amusement experience, the system comprising: at least one content delivery feature configured to deliver content to at least one user as at least part of an entertainment experience; a memory comprising a content database and a token database, wherein the content comprises a plurality of storylines for a plurality of missions for the amusement experience; a sensor configured to receive data identifying at least one token, wherein the at least one token is associated with the at least one user; and a processor configured to: receive token data from the sensor identifying the at least one token; retrieve attribute data from the token database, the attribute data identifying an attribute associated with the at least one token; select content for delivery based on the retrieved attribute data, wherein selecting content for delivery based on the retrieved attribute data comprises: identifying content in the content database as not previously delivered; and when all identified content has been previously delivered, selecting content from the identified and previously provided content in the content database based on the retrieved attribute data; retrieve the selected content for delivery from the content database; and provide the selected content to the at least one user.

2. The system of claim 1, wherein the at least one content delivery features comprises at least one of: a video presentation system; and an audio presentation system.

3. The system of claim 2, wherein the audio presentation system comprises at least one speaker.

4. The system of claim 1, wherein the at least one user is a holder of the at least one token.

5. The system of claim 1, wherein the attribute associated with the at least one token identifies at least one of: previously provided content associated with the at least one token; and a skill level associated with the at least one token.

6. The system of claim 5, wherein the selected content comprises narration indicative of the attribute associated with the at least one token.

7. The system of claim 5, wherein the selected content comprises at least a part of: a briefing, wherein the briefing comprises an introduction to the plurality of missions, wherein the plurality of missions comprises a plurality of tasks for completion by the at least one user, and wherein the plurality of tasks are linked in a narrative.

8. The system of claim 1, wherein the entertainment experience comprises at least one of: a film; a movie; a show; a simulation; an interactive story; and a video game.

9. The system of claim 1, wherein the received data from the at least one token comprises a unique identifier, wherein the unique identifier is not linked with the at least one user.

10. The system of claim 1, wherein the data received from the sensor identifies a plurality of tokens, wherein retrieved data from the token database is based on the data received identifying the plurality of tokens, and wherein the content is selected for delivery with retrieved data based on at least a portion of the retrieved data.

11. The system of claim 1, wherein the selecting content is based at least in part on at least one of the following attributes: an amount of time passed since last providing the previously provided content and a number of times that the previously provided content has been delivered.

12. A method for customized content delivery for an amusement experience, the method comprising: receiving with a processor data from a sensor, the data identifying at least one token, wherein the at least one token is associated with at least one user; retrieving with the processor attribute data from a token database, wherein the attribute data identifies an attribute associated with the at least one token; selecting with the processor content for delivery via at least one content delivery feature to the at least one user as at least part of an entertainment experience, wherein the content comprises a plurality of storylines for a plurality of missions for the amusement experience and is selected based on the retrieved attribute data, and wherein selecting content for delivery based on the retrieved attribute data comprises: identifying content in a content database as not previously delivered; and when all identified content has been previously delivered, selecting content from the identified and previously provided content in the content database based on the retrieved attribute data; retrieving with the processor the selected content for delivery from the content database; and providing the selected content to the at least one user.

13. The method of claim 12, wherein the selected content is provided to the at least one user via at least one of: a video presentation system; and an audio presentation system.

14. The method of claim 13, wherein the audio presentation system comprises at least one speaker.

15. The method of claim 12, wherein the at least one user is a holder of the at least one token.

16. The method of claim 12, wherein the attribute associated with the at least one token comprises at least one of: previously provided content associated with the at least one token; or a skill level associated with the at least one token.

17. The method of claim 16, wherein the selected content comprises narration indicative of the attribute associated with the at least one token.

18. The method of claim 13, wherein the selected content comprises at least a part of: a briefing, wherein the briefing comprises an introduction to the plurality of missions, wherein the plurality of missions comprises a plurality of tasks for completion by the at least one user, and wherein the plurality of tasks are linked in a narrative.

19. The method of claim 12, wherein the entertainment experience comprises at least one of: a film; a movie; a show; a simulation; an interactive story; and a video game.

20. The method of claim 12, wherein the received data from the at least one token comprises a unique identifier, wherein the unique identifier is not linked with the at least one user.

21. The method of claim 20, wherein the data received from the sensor identifies a plurality of tokens, wherein retrieved data from the token database is based on the data received identifying the plurality of tokens, and wherein the content is selected for delivery with retrieved data based on at least a portion of the retrieved data.

* * * * *